US006669319B2

(12) United States Patent
Shimizu

(10) Patent No.: US 6,669,319 B2
(45) Date of Patent: Dec. 30, 2003

(54) INK JET PRINTER AND PRINTING METHOD

(75) Inventor: Tohru Shimizu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/195,397

(22) Filed: Jul. 16, 2002

(65) Prior Publication Data

US 2003/0025752 A1 Feb. 6, 2003

(30) Foreign Application Priority Data

Jul. 16, 2001 (JP) ..... P. 2001-214602

(51) Int. Cl.[7] ..... B41J 2/205

(52) U.S. Cl. ..... 347/15; 347/14; 347/41; 347/43; 347/19

(58) Field of Search ..... 347/15, 43, 19, 347/16, 14, 41

(56) References Cited

U.S. PATENT DOCUMENTS 6,336,705 B1 * 1/2002 Torigoe ..... 347/43

6,474,779 B2 * 11/2002 Inui et al. ..... 347/43

FOREIGN PATENT DOCUMENTS

| | | |
|---|---|---|
| JP | 63-242642 | 10/1988 |
| JP | 3-45349 | 2/1991 |
| JP | 3-77066 B | 12/1991 |
| JP | 8-295034 | 11/1996 |
| JP | 11-207999 | 8/1999 |

* cited by examiner

*Primary Examiner*—Lamson Nguyen
(74) *Attorney, Agent, or Firm*—Morgan, Lewis & Bockius LLP

(57) ABSTRACT

On the basis of name of a printing medium, which is supplied from a printing medium specifying section, a recording pattern producing section determines whether the printing medium to be printed is a medium in which an ink easily penetrates or that in which an ink hardly penetrates, determines hue changing degree due to bidirectional printing for each pixel from position information of CMYK image data and a scanning pattern, and changes the densities of CMY so that the output density of a hue having a larger hue changing degree in the input image data is lowered, and that of a hue having a smaller hue changing degree is raised. As a result, a total amount of inks ejected from a head of an ink recording section is controlled with respect to the color which is early impacted and that which is lately impacted.

22 Claims, 5 Drawing Sheets

INK JET PRINTER AND PRINTING METHOD

The present disclosure relates to the subject matter contained in Japanese Patent Application No.2001-214602 filed on Jul. 16, 2001, which is incorporated herein by reference in its entirety.

BACKGROUND OF THE INVENTION

1. Field of the Invention

The present invention relates to an ink jet printer and a printing method and particularly to an ink jet printer and a printing method which perform bidirectional printing on a sheet using a head for ejecting inks of a plurality of colors.

2. Description of the Related Art

As an apparatus for outputting a digital color image, a color inkjet printer having inks of a plurality of colors has been proposed. Such an apparatus is widely used for printing an image. In an inkjet printer, while a head in which a plurality of nozzles are integrally arranged is moved in a direction (main scanning direction) perpendicular to a direction (sub-scanning direction) along which a printing medium such as a paper sheet is fed, ink particles ejected from the nozzles of the head are impacted on the printing medium, thereby forming ink dots on the medium to record an image. Inks of black (K), cyan (C), magenta (M), and yellow (Y) are used as those of basic colors.

In such an inkjet printer, in order to improve the printing speed, bidirectional printing is performed, i.e., ink ejection while moving the head in the main scanning direction is conducted in both the forward and reverse directions of the head. In the case of the bidirectional printing, when inks are impacted on the printing medium in the forward direction in the color sequence of KCMY, inks are impacted on the printing medium in the reverse direction in the opposite color sequence of YMCK.

This difference in color sequence of impacting inks causes a problem in that the hue is delicately varied because of the reason that will be described below. In the case where blue (B) is formed by inks of C and M, for example, the color tone of B which is formed in the forward direction in the color sequence of C and M is delicately different from that of B which is formed in the reverse direction in the color sequence of M and C. This causes the problem in that, although B of a uniform hue is originally to be printed, B is printed in color tones which are different from each other in a stripe-like manner along the main scanning direction.

In order to solve the problem, in JP-B-3-77066 and JP-A-8-295034, a printing method has been proposed in which heads or nozzles are disposed independently for the forward direction (for example, the sequence of KCMY) and the reverse direction (for example, the sequence of YMCK), thereby equalizing the color sequences of impacting inks with each other.

By contrast, JP-A-11-207999 discloses a printing method to be employed in an inkjet recording method in which inks are ejected in both the forward and reverse paths in the main scanning direction by using an inkjet head wherein nozzle groups each for different colors are arranged in the print operation direction (main scanning direction), and sub scanning is performed between the forward path and the reverse path, or between the reverse path and the forward path, thereby forming an image on a printing medium. In the printing method, when an image is to be formed on a printing medium by using a mixed color based on inks of different colors, an ink which is applied lately in the forward direction of the main scanning is ejected in an ejection amount smaller than an ink which is applied early, in both the forward and reverse paths. According to the printing method disclosed in the related art, a difference between displayed colors in the forward and reverse paths is eliminated to enable bidirectional printing in an inkjet printer.

In the printing method according to the related art disclosed in JP-B-3-77066 and JP-A-8-295034, the nozzle head for the reverse direction is not used in the forward direction, and that for the forward direction is not used in the reverse direction, thereby causing a problem in that, in order to realize the same printing speed as that in a conventional method, nozzles and heads which are twice in number are required.

By contrast, the printing method according to the related art disclosed in JP-A-11-207999 has a problem in that an adverse effect is produced depending on a printing medium to enhance the variation in hue. This is caused by the phenomenon that the manner of hue variation in bidirectional printing depends on a printing medium. Namely, the direction of hue variation in a printing medium into which an ink easily penetrates, such as recycled paper, plain paper, or coated paper is different from that in a printing medium into which an ink hardly penetrates, such as glossy paper, or an OHP sheet. This will be described by way of an example in which B is formed by C and M.

In a printing medium into which an ink easily penetrates, an ink of C which is early impacted stays in the surface and the inside of the medium, and an ink of M which is lately impacted penetrates so as to move round below the ink of C, so that a hue in which C that is early impacted is stronger is obtained. In a printing medium into which an ink easily penetrates, namely, the color of an ink that is early impacted is dominant. By contrast, in a printing medium into which an ink hardly penetrates, an ink of C that is early impacted stays in the surface of the medium, and an ink of M which is lately impacted flows onto the ink of C or a portion where the ink of C is not placed, so that a hue in which M that is lately impacted is stronger is obtained. In a printing medium into which an ink hardly penetrates, namely, the color of an ink that is lately impacted is dominant.

Therefore, the printing method which is disclosed in JP-A-11-207999 in which the ejection amount of an ink that is lately printed is made smaller is effective for a printing medium into which an ink hardly penetrates, and in which the color of an ink that is lately impacted is dominant. In the method, for a printing medium into which an ink easily penetrates, and in which the color of an ink that is early impacted is dominant, however, the color of the ink that is early impacted is stronger, or an adverse effect is produced.

Usually, glossy paper that is a printing medium into which an ink hardly penetrates is used in printing in which the image quality is more significant than the printing speed. In contrast, recycled paper, plain paper, or the like that is a printing medium into which an ink easily penetrates is used in printing in which the printing speed is more significant than the image quality. Bidirectional printing is performed in order to improve the printing speed. Therefore, the countermeasure against the above-mentioned problem of hue variation in bidirectional printing is more important in a printing medium into which an ink easily penetrates. As described above, however, the printing method according to the related art which is disclosed in JP-A-11-207999 has the problem in that the variation in hue is enhanced in recycled paper, plain paper, or the like which are subjected to bidirectional printing with a higher possibility.

The variation in hue appears in different manners depending on the mode of filling a printed region with dots. A head in which the density of nozzles (hereinafter, referred to as nozzle density) in the sub-scanning direction is equal to the dot recording density (dpi) on a printing medium will be considered. In the case where an image of a region of (the length of a nozzle row in the sub-scanning direction)×(the moving distance of the head in the main scanning direction) (hereinafter, such a region is referred to as raster) is formed by one movement of the head in the main scanning direction (hereinafter, such recording is referred to as one-pass raster recording), the hue variation in bidirectional printing appears alternately or for each raster, and hence is conspicuous.

In the case where an image for one raster is formed by plural reciprocal movements in the main scanning direction by using a similar head (hereinafter, such recording is referred to multi-pass recording), bidirectional printing allows dots of different hues to be printed in an alternate manner of a high frequency in the main scanning direction, and hence the variation in hue can be made inconspicuous. In such multi-pass recording, the number of scanning operations is larger than that in the one-pass recording, and hence there is a problem in that the printing speed is low.

In the case of a head in which the nozzle density is lower than the dot recording density (dpi) on a printing medium, dots for the recording density in the sub-scanning direction cannot be formed by one movement in the main scanning direction, and therefore the main scanning is performed several times (hereinafter, such recording is referred to as interlace recording). In this case, lines of different hues which are formed in the main scanning direction by bidirectional printing are formed in an alternate manner of a high frequency in the sub-scanning direction, and hence the variation in hue is hardly perceived.

In the multi-pass recording and the interlace recording, as compared with the one-pass raster recording, the speeds of dots which are impacted at one time on a printing medium are different. Therefore, inks penetrate in different manners, so that not only the easiness of perception of the variation in hue, but also the degree of the variation in hue are changed. Among printing media, or paper which is usually called recycled paper, factors such as the ratio of recycled pulp and the addition amount of a surface processing agent are different, and therefore inks penetrate in different manners. As described above, the hue variation due to bidirectional printing is different depending on the kind of a printing medium and the recording method, and therefore it is difficult to completely eliminate the hue variation.

SUMMARY OF THE INVENTION

The invention has been conducted in view of the above-discussed problems. It is an object of the invention to provide a printing apparatus and a printing method in which the hue variation in an image produced by bidirectional printing can be reduced irrespective the kind of a printing medium, a recording medium on which a program for the method is recorded, and a program.

In order to attain the object, according to a first aspect of the invention, there is provided an ink jet printer including a print head, a detection section, and a first control section. The print head has a nozzle array extending in a sub scanning direction. The nozzle array is arranged in a main scanning direction for each color. The print head reciprocally moves in the main scanning direction to print on a recording medium in both forward and reverse directions. The detection section detects a moving direction of the print head in the main scanning direction. The first control section increases an amount of an ink of a lately ejected color in comparison with an amount of an ink of a early ejected color irrespective of the moving direction of the print head detected by the detection section, when printing an image on the recording medium using a mixed color.

According to a second aspect of the invention, there is provided an ink jet printer including a print head, a hue changing degree storage section, a recording medium specifying section, a scanning pattern section, a hue changing degree determining section, and a data conversion section. The print head has a nozzle array extending in a sub scanning direction. The nozzle array is arranged in a main scanning direction for each color. The print head reciprocally moves in the main scanning direction to print on a recording medium in both forward and reverse directions. The hue changing degree storage section stores hue of each color in the forward and reverse directions at a time of printing an image on a recording medium with a mixed color. The recording medium specifying section determines a kind of the recording medium. The scanning pattern section determines a scanning pattern in the main scanning direction of the print head based on a recording mode inputted from external. The hue changing degree determining section refers the hue changing degree storage section to determine the hue changing degree of each color based on the determined kind of the recording medium and the determined scanning pattern. The data conversion section converts image data to be printed based on the determined hue changing degree.

According to a third aspect of the invention, there is provided a printing method using a print head. The print head has a nozzle array extending in a sub scanning direction. The nozzle array is arranged in a main scanning direction for each color. The print head reciprocally moves in the main scanning direction to print on a recording medium in both forward and reverse directions. The printing method includes the steps of detecting a moving direction of the print head in the main scanning direction and increasing an amount of an ink of a lately ejected color in comparison with an amount of an ink of a early ejected color irrespective of the detected moving direction of the print head, when printing an image on the recording medium using a mixed color.

According to a fourth aspect of the invention, there is provided a printing method using a print head. The print head has a nozzle array extending in a sub scanning direction. The nozzle array is arranged in a main scanning direction for each color. The print head reciprocally moves in the main scanning direction to print on a recording medium in both forward and reverse directions. The method includes the steps of determining a kind of the recording medium, determining a scanning pattern in the main scanning direction of the print head based on a recording mode inputted from external, referring hue changing degree storage means for storing hue of each color in the forward and reverse directions at a time of printing an image on a recording medium with a mixed color, to determine the hue changing degree of each color based on the determined kind of the recording medium and the determined scanning pattern, converting image data to be printed based on the determined hue changing degree.

DETAILED DESCRIPTION OF THE PREFERRED EMBODIMENTS

In the specification, a main scanning direction means a direction along which nozzle rows are reciprocally moved. A sub-scanning direction means a direction which is perpendicular to the main scanning direction and along a direction in which a printing medium is transported.

Figure 1:
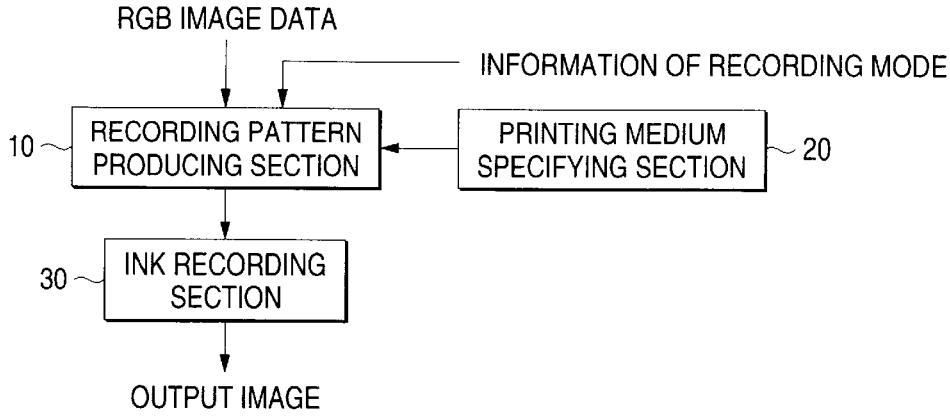
FIG. 1 is a block diagram of a first embodiment of the printing apparatus of the invention.

Next, embodiments of the invention will be described with reference to the accompanying drawings. FIG. 1 is a block diagram of a first embodiment of the printing apparatus of the invention. As shown in the figure, the printing apparatus of the embodiment is configured by: a recording pattern producing section 10 which produces a recording pattern; a printing medium specifying section 20 which specifies the kind of a printing medium that is to be currently subjected to printing; and an ink recording section 30 which outputs an image that is to be printed onto the printing medium.

Figure 2:
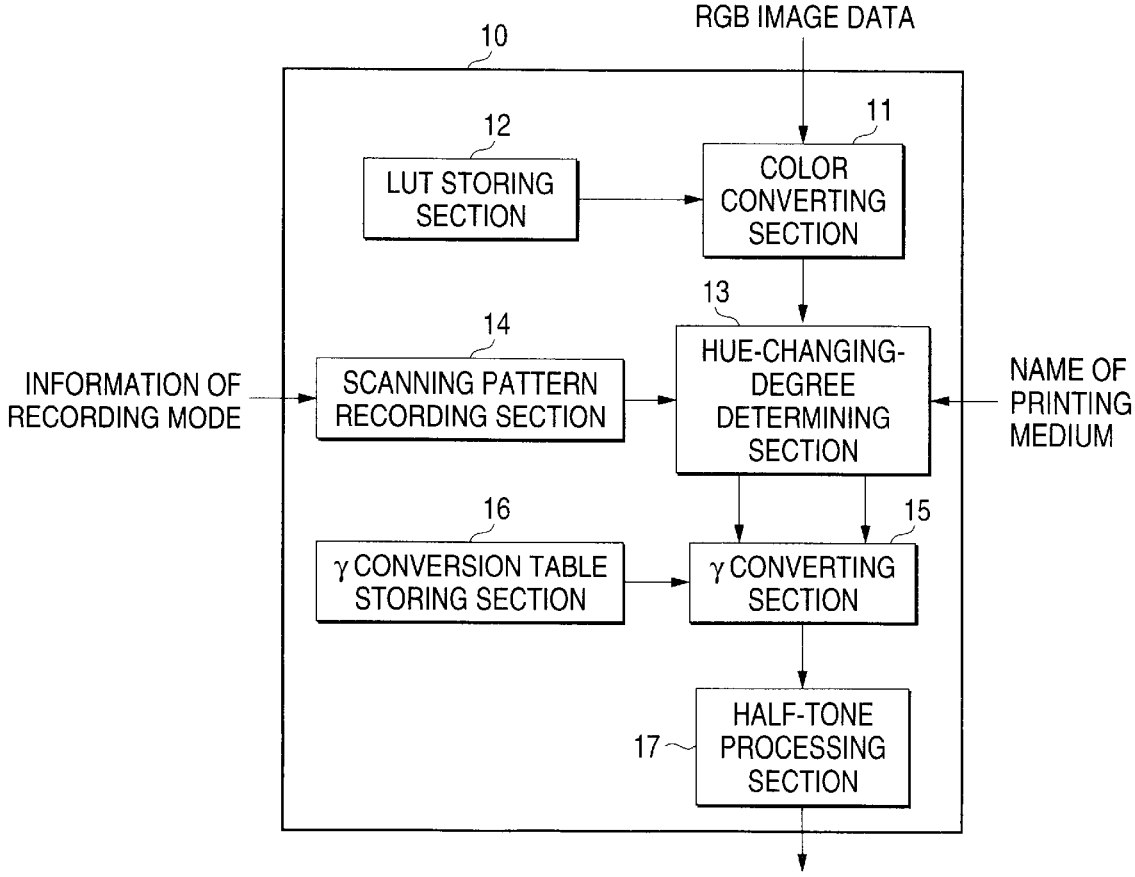
FIG. 2 is a block diagram of an embodiment of a recording pattern producing section in FIG. 1.

FIG. 2 is a block diagram of an embodiment of the recording pattern producing section 10 in FIG. 1. The recording pattern producing section 10 is a block which characterizes the embodiment, and which may be realized by a program(s) that is stored in a read-only memory (ROM) in the printing apparatus, or by loading such a program from a recording medium such as a CD-ROM to a computer that is connected to the printing apparatus.

As shown in FIG. 2, the recording pattern producing section 10 is configured by a color converting section 11, an LUT storing section 12, a hue-changing-degree determining section 13, a scanning pattern recording section 14, a γ converting section 15, a γ conversion table storing section 16, and a half-tone processing section 17. The LUT storing section 12 previously stores a color conversion table (LUT: look up table) for converting image data of red (R), green (G), and blue (B) which are the three primary colors of the additive color mixture, into those of four colors in total, i.e., C, M, and Y which are the three primary colors of the subtractive color mixture, and black (K).

Figure 5:
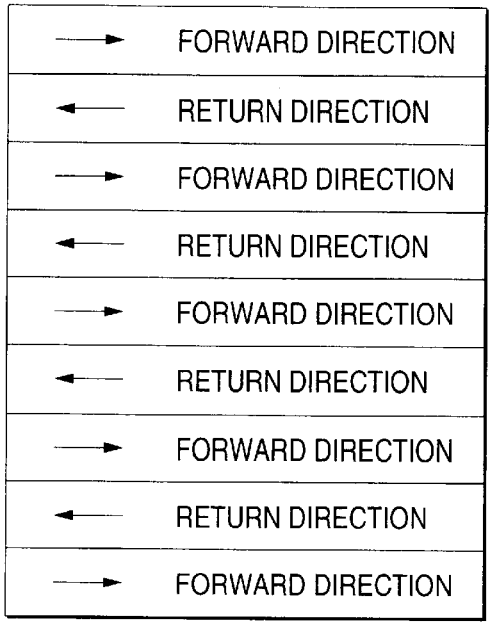
FIG. 5 is a view showing an example of a scanning pattern.

For each of recording modes, the scanning pattern recording section 14 stores information such as shown in FIG. 5 and indicative of whether each pixel on a printing medium is to be recorded in the forward direction or the reverse direction of a head (hereinafter, such information is referred to as scanning pattern). The scanning pattern of FIG. 5 shows the case where one-pass raster recording is performed by bidirectional printing using a head in which the nozzle density is equal to the dot recording density, and the forward direction is replaced with the reverse direction or vice versa at intervals corresponding to the length of the nozzle row. In the case where interlace recording is performed by bidirectional printing using a head in which the nozzle density is smaller than the dot recording density, a pattern is used in which the forward direction is replaced with the reverse direction or vice versa at each lateral one-dot line. The γ conversion table storing section 16 previously stores a γ conversion table for changing the density characteristics of image data.

Figure 3:
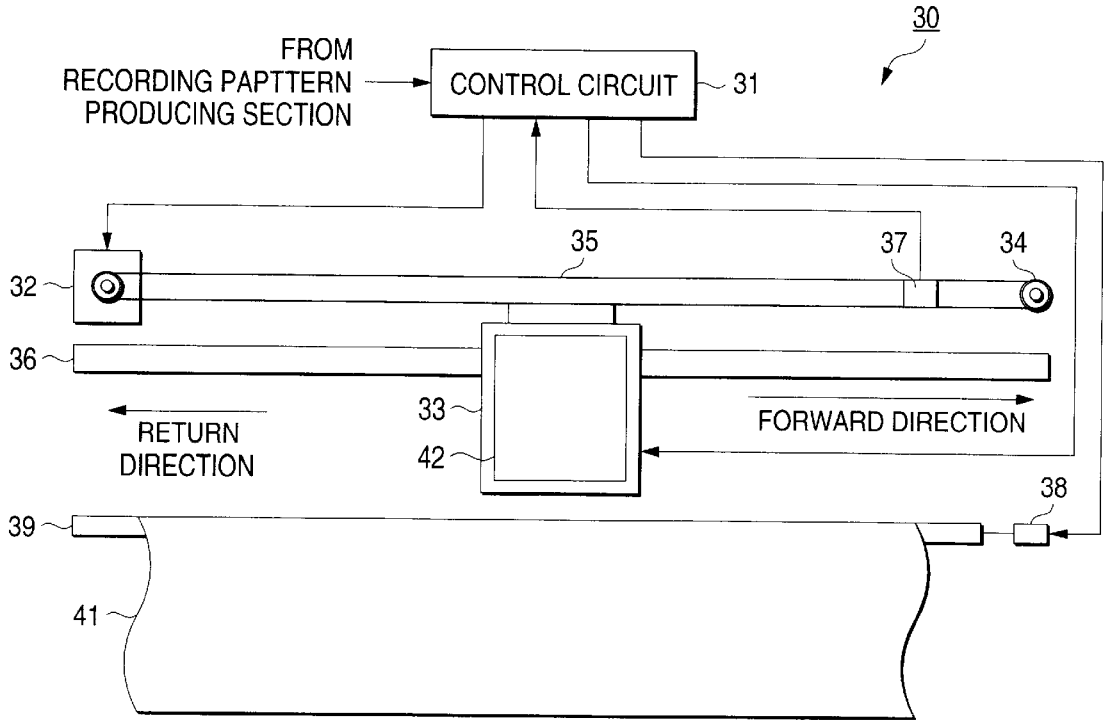
FIG. 3 is a diagram showing an example of the configuration of an ink recording section.

Next, the ink recording section 30 of FIG. 1 will be described. FIG. 3 is a diagram schematically showing an example of the configuration of the ink recording section 30. Referring to FIG. 3, the ink recording section 30 is configured by: a control circuit 31 which governs various controls; a carriage motor 32; a driving belt 35 to which a part of a carriage 33 is fixed at a predetermined position, and which is stretched between the rotation shaft of the carriage motor 32 and a pulley 34; a shaft 36 which supports transfer of the carriage 33; a position detecting sensor 37 which detects the origin of the carriage 33; a mechanism which transports a printing medium 41 by means of a sheet feeding motor 38 and a platen 39; and a mechanism which drives a printing head section 42 on the carriage 33 to eject inks.

The carriage motor 32, the pulley 34, the driving belt 35, the shaft 36 which is disposed in parallel with the shaft of the platen 39, and the position detecting sensor 37 constitute a mechanism which reciprocally moves the carriage 33 in the axial direction of the platen 39. Specifically, the driving belt 35 is moved in a direction corresponding to the rotation direction of the carriage motor 32, and in accordance with this movement the carriage 33 and the printing head section 42 are guided by the shaft 36 to be transferred in the direction (forward direction) toward the position where the carriage motor 32 is disposed or in the direction (reverse direction) toward the position where the pulley 34 is disposed.

The control circuit 31 receives information indicative of the record direction and the ejection amounts of inks of CMYK, from the recording pattern producing section 10, and executes the recording process. The printing medium 41 is transported in a direction (sub-scanning direction) perpendicular to the transferring direction (forward direction and reverse direction) of the carriage 33 and the printing head section 42 which coincides with the main scanning direction.

Figure 4:
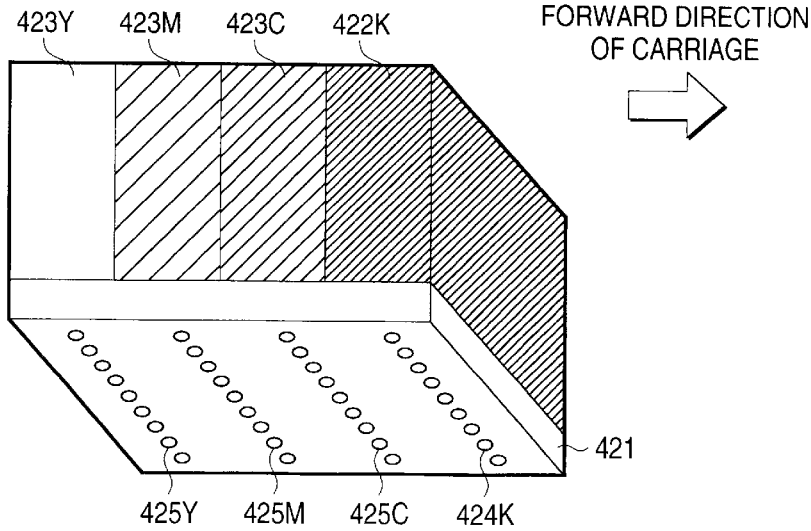
FIG. 4 is a schematic perspective view of an example of a printing head section in FIG. 3.

FIG. 4 is a diagram showing an example of the printing head section 42, looking from in a diagonally downward direction (from the side of the printing medium). Referring to the figure, the printing head section 42 is configured by a head main unit 421, a black ink cartridge 422K, and color ink cartridges 423C, 423M, and 423Y of C, M, and Y. The ink cartridges are disposed above the head main unit. Nozzle rows 424K, 425C, 425M, and 425Y respectively corresponding to the colors of the inks of the upper ink cartridges are mounted on the head main unit 421.

Each of the nozzle rows is formed by a plurality of nozzles which are arranged in the feeding direction of the printing medium 41. The nozzle rows 424K, 425C, 425M, and 425Y are arranged in a direction perpendicular to the feeding direction of the printing medium 41 (i.e., in the moving direction of the carriage 33), and in the sequence of Y (the nozzle row 425Y), M (the nozzle row 425M), C (the nozzle row 425C), and K (the nozzle row 424K) with starting from the left in FIG. 4. It is assumed that, when the carriage-is moved from the left to the right in FIG. 4, the carriage is moved in the forward direction, and, when the carriage is moved from the right to the left, the carriage is moved in the reverse direction. Therefore, inks are impacted on the printing medium 41 in the sequence of KCMY in the forward direction, and in the sequence of YMCK in the reverse direction.

In the head main unit 421, the inks are supplied from the cartridges 422K, 423C, 423M, and 423Y to the nozzle rows 424K, 425C, 425M, and 425Y, respectively. A piezoelectric element (not shown) is disposed in each of nozzles constituting the nozzle rows 424K, 425C, 425M, and 425Y. As well known in the art, a piezoelectric element has a characteristic that, when a voltage is applied to the piezoelectric element, its shape is changed. By using this shape change, the ink in the upper ink cartridge is ejected from the nozzle to form a dot on the printing medium, thereby performing printing (recording). At this time, the size of the dot can be adjusted by controlling the shape change of the piezoelectric element.

In the embodiment, the system comprising a head which ejects an ink by means of a piezoelectric element is used. Alternatively, a printing apparatus in which an ink is ejected by another method may be used. For example, the invention may be applied also to a printing apparatus in which an ink is ejected by means of a bubble which is produced by supplying-heat to the vicinity of a nozzle (the size of the dot is adjusted in accordance with the amount of supplied heat).

Returning to FIG. 1, the printing medium specifying section 20 has a function of determining the kind of the printing medium that is to be currently subjected to printing. In the embodiment, when the user of the printing apparatus sets the recording mode (for example, fine, fast, photograph, graph, and the like), the user designates the kind of the printing medium (for example, plain paper, coated paper, glossy paper, glossy film, OHP sheet, and the like), and the information of the designation is used. The invention is not restricted to this method, and may employ a method in which features of the medium (smoothness, surface glossiness, weight, and the like) are measured, and the kind thereof is automatically determined.

Next, the operation of the embodiment will be described. RGB image data which are to be printed are supplied to the color converting section 11 of the recording pattern producing section 10, and then converted from the three colors of RGB into the four colors of CMYK in accordance with the color conversion table of the LUT storing section 12. The converted data are supplied to the hue-changing-degree determining section 13. On the other hand, the information of the recording mode is supplied to the scanning pattern recording section 14 of the recording pattern producing section 10, and a scanning pattern corresponding to the inputted recording mode is selected in the scanning pattern recording section 14. The selected scanning pattern is supplied to the hue-changing-degree determining section 13.

On the basis of the name of the printing medium which is supplied from the printing medium specifying section 20, the hue-changing-degree determining section 13 determines whether the printing medium on which printing is to be performed is a medium in which an ink easily penetrates (an ink that is early impacted is stronger), or that in which an ink hardly penetrates (an ink that is lately impacted is stronger). From the position information of the CMYK image data and the scanning pattern supplied from the scanning pattern recording section 14, the hue-changing-degree determining section 13 determines the degree of the hue change due to bidirectional printing for each pixel (hereinafter, such a degree is referred to as hue changing degree) and supplies the hue changing degree to the γ converting section 15.

In the case where the printing medium 41 is plain paper, for example, the hue changing degree is larger in the sequence of CMY when the pixel of interest is in the forward direction, and larger in the sequence of YMC when the pixel of interest is in the reverse direction. In the case where the printing medium 41 is glossy paper, the hue changing degree is larger in the sequence of YMC when the pixel of interest is in the forward direction, and larger in the sequence of CMY when the pixel of interest is in the reverse direction. The hue changing degree is varied depending also on the scanning pattern. Hue changing degrees corresponding to names of printing media and scanning patterns are previously set based on experiments by the developer of the printing apparatus.

On the basis of the γ conversion table supplied from the γ conversion table storing section 16, and the hue changing degree supplied from the hue-changing-degree determining section 13, the γ converting section 15 changes the densities of CMY so that the output density of a hue having a larger hue changing degree in the input image data is lowered, and that of a hue having a smaller hue changing degree is raised, and then supplies image data (CMY data) to the half-tone processing section 17.

The density change in CMY due to the hue changing degree will be described by way of a specific example in a plain-paper standard recording mode. Assuming that, in the plain-paper standard recording mode, one-pass raster recording is bidirectionally performed on plain paper, the scanning pattern shown in FIG. 5 is used. Specifically, in the case where the printing apparatus has a head in which one nozzle row is configured by 80 nozzles, the scanning pattern is a pattern in which the scanning direction is switched over between the forward and reverse directions at intervals of 80 dots, or, when image data are expressed in the xy coordinate in which the origin is in an upper left position, dots of the y-coordinate between 0 to 79 are in the forward direction, those of the y-coordinate between 80 to 159 are in the reverse direction, those of the y-coordinate between 160 to 239 are in the forward direction, . . .

On the basis of the scanning pattern information, the hue-changing-degree determining section 13 allocates a hue changing degree to each of the dots of the image data. It is assumed that the hue changing degrees in bidirectional printing in one-pass raster recording on plain paper are stored as values listed Table 1, in accordance with experiments which were conducted during the development of the printing apparatus by the developer.

TABLE I

| | C | M | Y |
|---|---|---|---|
| Forward direction | 1.10 | 1.0 | 0.95 |
| Reverse direction | 0.9 | 1.0 | 1.05 |

In the example of Table 1, the hue changing degree of dots of the image data in which the y-coordinate is 0 to 79 is set so that C is 1.10, M is 1.0, and Y is 0.95, and that of dots of the image data in which the y-coordinate is 80 to 159 is set so that C is 0.9, M is 1.0, and Y is 1.05.

In the γ converting section 15, when the image data are to be subjected to the γ conversion, the value of the γ conversion table is divided by the value of the hue changing degree of each color in the dot of interest, thereby changing the output density in accordance with the hue changing degree. In the above-mentioned experiments of obtaining the hue changing degree, the hue changing degree is previously obtained as a value at which the hue change due to bidirectional printing is reduced by changing the γ conversion table by means of such a calculation.

Figure 8:
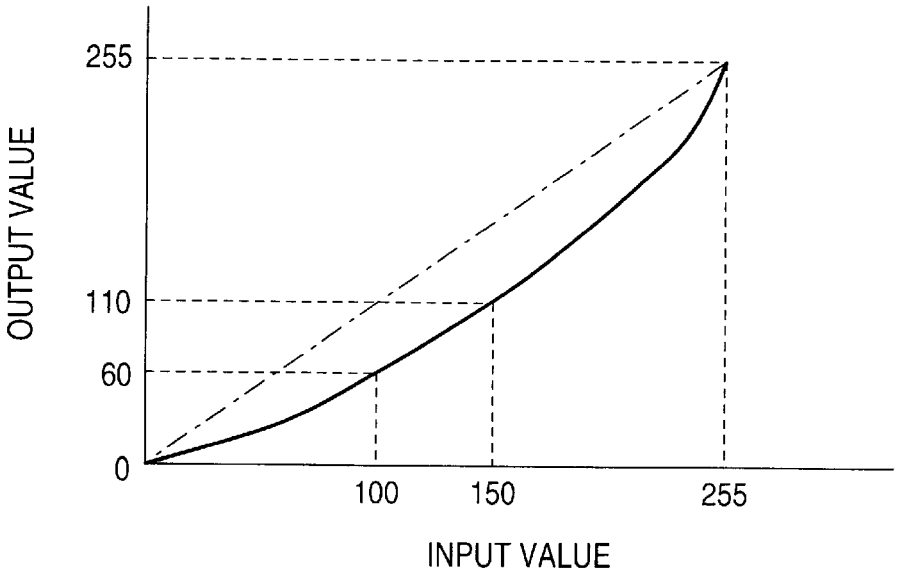
FIG. 8 is a view showing an example of a γ conversion table.

It is assumed that γ conversion based on the γ conversion table for the plain-paper standard recording mode stored in the γ conversion table storing section 16 is conversion shown in FIG. 8. In the figure, the abscissa shows a data before conversion (input value), and the ordinate shows a data after conversion (output value). In this case, when a green data in which the y-coordinate of the image data is 0 to 79, C is 100, M is 0, and Y is 150 (in the usual γ conversion in the γ conversion table of FIG. 8, C is 60, M is 0, and Y is 110) is subjected to the γ conversion in which the hue changing degree is considered, for example, C is 55 (=60/1.1), M is 0, and Y is 116 (=110/0.95). When a green data in which the y-coordinate of the image data is 80 to 159, C is 100, M is 0, and Y is 150 is subjected to the γ conversion in which the hue changing degree is considered, C is 67 (=60/0.9), M is 0, and Y is 105 (=110/1.05).

By the method described above, the γ converting section 15 of FIG. 2 changes the densities of CMY so that the output density of a color having a larger hue changing degree is lowered, and that of a color having a smaller hue changing degree is raised. The input data of the hue of K is output as it is through the γ converting section 15.

The image data taken out from the γ converting section 15 of FIG. 2 and consisting of the data of CMY in which the output density is changingly controlled in accordance with the hue changing degree, and the data of K in which the output density is not changingly controlled are supplied to the half-tone processing section 17. In the section, the image data of CMYK of 256 gradations of color are quantized into data of the number of gradations at which the ink recording section 30 can perform recording. The image data which have been quantized by the half-tone processing section 17 are supplied as information indicative of the ejection amounts of inks of CMYK, to the control circuit 31 of the ink recording section 30 shown in FIG. 3, and the recording process is then performed. At this time, the quantized imaged data are sent from the control circuit 31 to the printing head section 42 so that corresponding inks from the nozzle rows of the corresponding color are impacted on the printing medium 41.

As described above, according to the first embodiment of the invention, based on the kind of a printing medium that is to be currently subjected to printing and the scanning pattern, the hue changing degree is obtained as a value at which the hue change due to bidirectional printing is reduced, and the output density is changingly controlled in accordance with the hue changing degree. As a result, in printing on a printing medium in which an ink easily penetrates, the total amount of an ink (i.e., the ejection amount of an ink per unit area) which is lately impacted in bidirectional printing can be made larger than that of an ink which is early impacted, and, in printing on a printing medium in which an ink hardly penetrates, the total amount of an ink which is lately impacted can be made smaller than that of an ink which is early impacted.

According to the embodiment, therefore, bidirectional printing of reduced hue variation can be realized both on a printing medium in which an ink easily penetrates and that in which an ink hardly penetrates, without increasing the number of nozzles or heads, or without lowering the printing speed.

Next, a second embodiment of the invention will be described. The second embodiment is characterized in that the hue changing degree, which, in the first embodiment, is set in accordance with experiments that were conducted during the development of the printing apparatus by the developer, is set in accordance with test recording by the user of the printing apparatus. According to the configuration, it is possible to cope with the problem in that the manner of penetration of an ink is varied and the degree of the hue difference in bidirectional printing is varied, because, even in the same name of a printing medium, such as plain paper or recycled paper, factors such as the ratio of recycled pulp and the addition amount of a surface processing agent are delicately different. Since the test recording is set so as to be performed once only in the case of an unknown printing medium, the problem in that the time period required for the printing process is prolonged does not occur.

Figure 6:
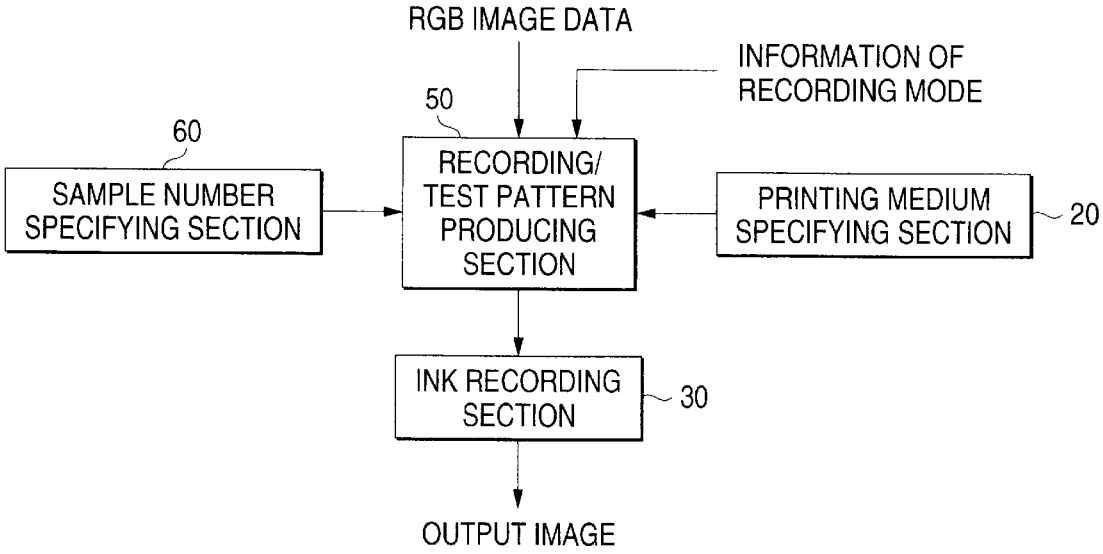
FIG. 6 is a block diagram of a second embodiment of the printing apparatus of the invention.

FIG. 6 is a block diagram of the second embodiment of the printing apparatus of the invention. In the figure, the identical components as those of FIG. 1 are denoted by the same reference numerals, and their description is omitted. As shown in FIG. 6, the printing apparatus of the second embodiment is configured by the printing medium specifying section 20, the ink recording section 30, a recording/test pattern producing section 50, and a sample number specifying section 60, and operates in different manners in the test recording and the image data recording.

In the test recording, the recording/test pattern producing section 50 prints several test sample charts in each recording mode, and, on the basis of a result of the printing, determines the hue changing degree by means of a sample number supplied from the sample number specifying section 60. In the image data recording, the recording/test pattern producing section 50 performs a process of recording image data by using the hue changing degree which is determined in the test recording. The recording/test pattern producing section 50 operates in different manners in the test recording and the image data recording. The test recording is performed when the user of the printing apparatus designates the test recording, or when the printing medium has not yet been used and the degree of ink penetration into the printing medium is not known.

Figure 7:
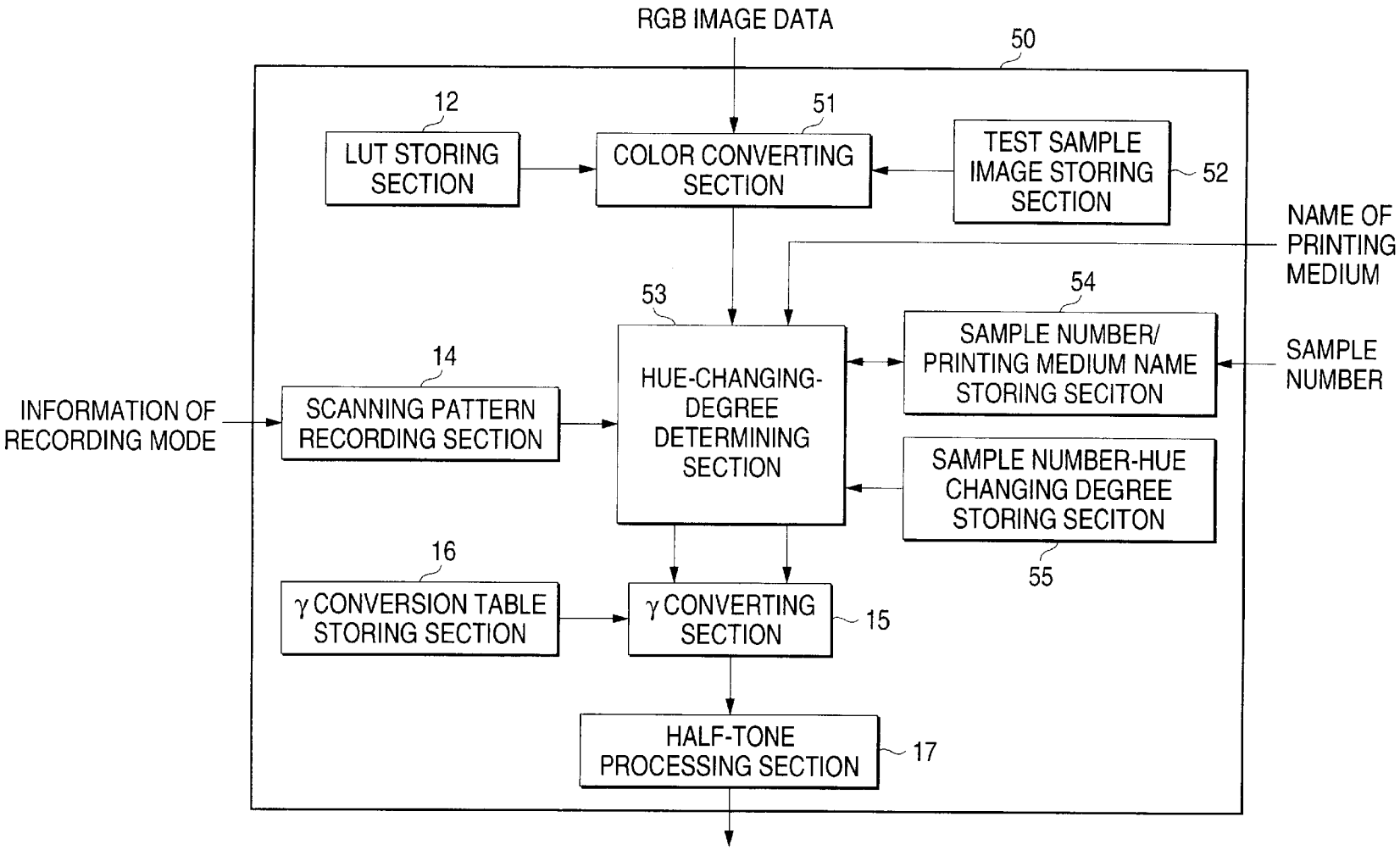
FIG. 7 is a block diagram of an embodiment of a recording/test pattern producing section in FIG. 6.

FIG. 7 is a block diagram of an embodiment of the recording/test pattern producing section 50 shown in FIG. 6. In FIG. 7, the identical components as those of FIG. 2 are denoted by the same reference numerals, and their description is omitted. As shown in FIG. 7, the recording/test pattern producing section 50 is configured by a color converting section 51, a test sample image storing section 52, a hue-changing-degree determining section 53, a sample number/printing medium name storing section 54, a sample number-hue changing degree storing section 55, the LUT storing section 12, the scanning pattern recording section 14, the γ converting section 15, the γ conversion table storing section 16, and the half-tone processing section 17. The functions of the blocks of the recording/test pattern producing section 50 may be realized by a program(s) that is stored in a ROM in the printing apparatus, or by loading such a program from a recording medium such as a CD-ROM to a computer that is connected to the printing apparatus.

Referring to FIG. 7, the test sample image storing section 52 stores image data of test samples which will be described later, and also sample numbers. The sample number/printing medium name storing section 54 stores names of printing media, and sample numbers corresponding to the names, and can further store the name of a new printing medium. The sample number-hue changing degree storing section 55 stores sample numbers and hue changing degrees corresponding to the sample names. The hue-changing-degree determining section 53 judges whether the test recording is necessary or not, and determines the hue changing degree which is required in the current recording process (printing process).

Each of test sample images stored in the test sample image storing section 52 includes colors (for example, red, blue, and green) in which a hue difference due to bidirectional printing easily appears, and is arranged at position where recording processes in both the forward and reverse directions, which use scanning patterns corresponding to recording modes, are performed. Also the sample numbers corresponding to hue changing degrees in recording of the test sample images are stored. In recording of the test sample images, the hue changing degree corresponding to the sample number stored in the sample number-hue changing degree storing section 55 is used.

The sample number-hue changing degree storing section 55 stores several hue changing degrees which are previously obtained by the developer of the printing apparatus, and which are centered at and around the hue changing degree of a specific printing medium that has average characteristics or that is most frequently used, among categories of printing media such as recycled paper, plain paper, special paper, glossy paper, and an OHP sheet. The sample number-hue changing degree storing section 55 stores also sample numbers corresponding to the hue changing degrees. Among printing media of the same category, the hue difference in bidirectional printing due to variations of the manufacture and lots are not so large. In the several hue changing degrees, therefore, there is a degree at which the hue difference can be reduced most effectively by the countermeasure against the hue variation due to bidirectional printing which has been described in the first embodiment.

Figure 9:
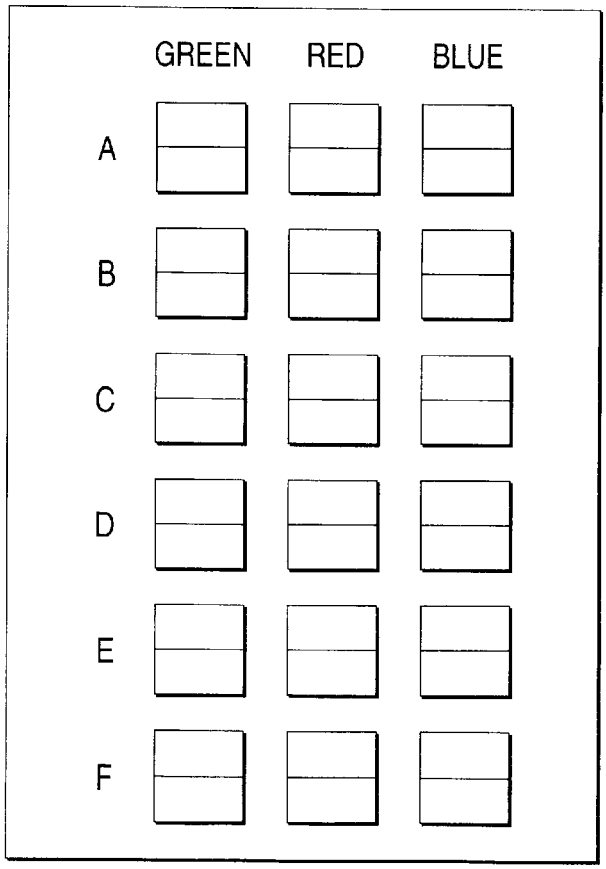
FIG. 9 is a view showing an example of a test sample image in an embodiment of the invention.

FIG. 9 is a conceptual diagram of an example of the test sample images. Referring to the figure, green, red, and blue images are formed with starting from the left columns. The upper half of one rectangle (referred to as patch) is printed in the forward direction, and the lower half is printed in the reverse direction. In the three patches in each horizontal row, countermeasures against the hue variation due to bidirectional printing and based on the same hue changing degree are taken. The alphabets in FIG. 9 are used as symbols for identifying a patch of hue variation in which the hue difference is most inconspicuous.

In the test samples in which the effects of the countermeasures against the hue variation are delicately different, there is a sample in which the hue difference in bidirectional printing is reduced most effectively. When the user of the printing apparatus selects the sample, it is possible to obtain the optimum hue changing degree. In the image data recording, a printing process is performed with using the hue changing degree and by the method used in the first embodiment, so that a countermeasures against the hue variation in bidirectional printing and based on the hue changing degree suitable for the printing medium can be taken.

Next, the operation of the embodiment will be described. First, a printing process is performed on a test sample image which is stored in the test sample image storing section 52 corresponding to the objective record mode and printing medium. The color converting section 51 of the recording/test pattern producing section 50 shown in FIG. 7 converts RGB image data of a test sample which is supplied from the test sample image storing section 52, from the three colors of RGB into the four colors of CMYK in accordance with the color conversion table of the LUT storing section 12. The converted data are supplied to the hue-changing-degree determining section 53.

The hue-changing-degree determining section 53 reads out the hue changing degree corresponding to the sample number of the sample image data, from the sample number-hue changing degree storing section 55, and supplies the degree to the γ converting section 15. In the same operation as that which has been described in the first embodiment, thereafter, the sample data are converted into record data in which the effects of the-countermeasures against the hue variation in bidirectional printing are delicately different. The converted data are sent to the ink recording section 30, and a process of printing the test sample images is then executed.

On the basis of the result of the determination conducted by the user of the printing apparatus, or information from a color difference measuring apparatus such as a colorimeter, the sample number specifying section 60 of FIG. 6 captures the sample number of a patch in which the color difference in bidirectional printing is smallest, from the samples of the result of the test recording. Based on the sample number supplied from the sample number specifying section 60, the sample number/printing medium name storing section 54 of FIG. 7 correspondingly stores the supplied sample number and the printing medium name which specifies the printing medium of the current interest.

Next, the operation in printing of usual image data will be described. RGB image data which are to be printed are supplied to the color converting section 51 of the recording/test pattern producing section 50, and then converted from the three colors of RGB into the four colors of CMYK in accordance with the color conversion table of the LUT storing section 12. The converted data are supplied to the-hue-changing-degree determining section 53.

The hue-changing-degree determining section 53 checks the printing medium name which is supplied from the printing medium specifying section 20, and which is to be used in the current printing with that which is stored in the sample number/printing medium name storing section 54. If the supplied printing medium name coincides with a stored name, it is judged to perform the operation of image data recording. The hue-changing-degree determining section 53 then receives the sample number corresponding to the printing medium name from the sample number/printing medium name storing section 54, and the hue changing degree corresponding to the sample number from the sample number-hue changing degree storing section 55, and supplies the hue changing degree to the γ converting section 15. Thereafter, the process of printing the image data is performed by the same method as that of the first embodiment.

By contrast, if the printing medium name which is supplied from the printing medium specifying section 20, and-which is to be used in the current printing is not stored in the sample number/printing medium name storing section 54, the hue-changing-degree determining section 53 requests the user to start the test recording, or executes the above-mentioned test recording. For example, the request for the test recording may be made in the following manner. A display section is disposed on the printing apparatus, or the request is displayed on a display device of a computer connected to the printing apparatus. The manner of making the request is not related to the spirit of the invention, and hence its detailed description is omitted.

As described above, in the embodiment, the optimum hue changing degree at which the hue difference in bidirectional printing is smallest is selected on the basis of a result of the test recording, the sampling number and the hue changing degree at this time are correspondingly stored into the sample number-hue changing degree storing section 55, and the printing medium name and the sample number at this time are stored into the sample number/printing medium name storing section 54. In image data recording, the sample number corresponding to the name of the printing medium to be used is read out from the sample number/printing medium name storing section 54. On the basis of the sample number, the hue changing degree is captured from the sample number-hue changing degree storing section 55, and the γ converting process is performed based on the hue changing degree and the γ conversion table. Therefore, the embodiment can cope with the problem in that, even in printing media of the same name, factors such as the ratio of pulp and the addition amount of a surface processing agent are delicately different depending on the manufacture and lots, and hence inks penetrate in different manners and the degree of the hue difference in bidirectional printing is varied. Therefore, a countermeasure against the color difference in bidirectional printing and based on the hue changing degree which is most suitable for the printing medium of the current interest can be taken, and it is possible to realize a printing process in which the color difference in bidirectional printing is reduced.

The invention embraces not only a recording medium (such as a CD-ROM) on which a program(s) for causing a computer internally or externally connected to the printing apparatus to perform the operation of each of the embodiments is recorded, and which is readable by a computer, but also such a program itself. The program of the invention includes a program which is recorded on a recording medium, and also a program which is delivered through a communication network such as the Internet, or the like.

The invention is not restricted to the embodiments described above, and embraces various modifications. In the first embodiment, the hue changing degree of each color is constant irrespective of the density. Alternatively, the value may be changed depending on the density of the original data. As the density of the original data is higher, the variation in hue is more conspicuous. Therefore, the hue changing degree may be set so as to be larger as the density of the original data is higher. In the first embodiment, the output density is changed in accordance with the hue changing degree, by dividing the value of the γ conversion table by that of the hue changing degree. The change may be realized by another method such as that in which the hue changing degree is subtracted from the value of the γ conversion table, or that in which correction amounts of the γ conversion table with respect to the hue changing degree are previously stored in the form of a table.

As the method of changing the ink amount with respect to the hue changing degree, a method such as that in which the color conversion table is changed, that in which results of the half-tone process are further decimated to reduce the ink amount, or that in which the amount of ejected ink is increased or decreased may be employed.

The test sample images used in the second embodiment are not restricted to that shown in FIG. 9. The number and shape of the images may be set to be different from those of FIG. 9. In the second embodiment, the hue changing degree is obtained in accordance with the sample number corresponding to a patch of the test sample. Alternatively, the hue changing degree may be obtained on the basis of information indicative of the middle between the sample numbers. In the case where the effect of a patch of the row of C in FIG. 9 is slightly small and that of a patch of the row of D is slightly large, for example, a method may be used in which a middle value between the hue changing degrees is employed.

As described above, according to the invention, in printing on a printing medium that is determined as a kind in which an ink easily penetrates or the color of an ink that is early impacted is dominant, the density of an ink which is lately impacted is made stronger, and, in printing on a printing medium that is determined as a kind in which an ink hardly penetrates or the color of an ink that is lately impacted is dominant, the density of an ink which is early impacted is made stronger. Therefore, the hue difference between forward printing and reverse printing can be made smaller than that in the conventional art on both a printing medium in which an ink easily penetrates and that in which an ink hardly penetrates, without increasing the number of nozzles or heads, or without lowering the printing speed.

According to the invention, moreover, test printing is previously performed, and, on the basis of a result of the printing, an ink ratio at which a test pattern in which the difference between the hue of a pixel in forward printing and that of the pixel in reverse printing is smallest is obtained, and the kind of the printing media in this case are stored in the storing section. In printing of image data, the ink ratio corresponding to the kind of a printing medium which is used in the printing is read out from the storing section, and bidirectional printing is then performed, thereby minimizing the difference between the hue of a pixel in forward printing and that of the pixel in reverse printing. Even when, among printing media of the same kind, factors such as the ratio of pulp and the addition amount of a surface processing agent are delicately different, therefore, bidirectional printing is enabled in which the hue difference between forward printing and reverse printing is substantially eliminated.

What is claimed is:

1. An ink jet printer comprising:

a print head having a nozzle array extending in a sub scanning direction wherein the nozzle array is arranged in a main scanning direction for each color and the print head reciprocally moves in the main scanning direction to print on a recording medium in both forward and reverse directions;

detection means for detecting a moving direction of the print head in the main scanning direction; and first control means for increasing an amount of an ink of a lately ejected color in comparison with an amount of an ink of a early ejected color irrespective of the moving direction of the print head detected by the detection means, when printing an image on the recording medium using a mixed color.

2. The ink jet printer according to claim 1, further comprising recording medium specifying means for determining a kind of the recording medium, wherein the first control means controls the increase of the amount of the ink based on the determined kind of the recording medium.

3. The ink jet printer according to claim 2, wherein the recording medium specifying means determines the kind of the recording medium based on an input by user.

4. The ink jet printer according to claim 1, further comprising second control means for decreasing the amount of ink of the lately ejected color in comparison with the amount of the ink of the early ejected color irrespective of the moving direction of the print head detected by the detection means.

5. The ink jet printer according to claim 4, further comprising recording medium specifying means for determining a kind of the recording medium, wherein one of the increase and decrease of the amount of the ink is controlled by one of the first and second control means based on the kind of the recording medium determined by the recording medium specifying means.

6. The ink jet printer according to claim 5, wherein the recording medium specifying means determines the kind of the recording medium based on an input by user.

7. An ink jet printer comprising:

a print head having a nozzle array extending in a sub scanning direction wherein the nozzle array is arranged in a main scanning direction for each color and the print head reciprocally moves in the main scanning direction to print on a recording medium in both forward and reverse directions;

hue changing degree storage means for storing hue of each color in the forward and reverse directions at a time of printing an image on a recording medium with a mixed color;

a recording medium specifying section for determining a kind of the recording medium;

a scanning pattern section for determining a scanning pattern in the main scanning direction of the print head based on a recording mode inputted from external;

a hue changing degree determining section for referring the hue changing degree storage means to determine the hue changing degree of each color based on the determined kind of the recording medium and the determined scanning pattern;

a data conversion section for converting image data to be printed based on the determined hue changing degree.

8. The ink jet printer according to claim 7, wherein the recording medium specifying section determines the kind of the recording medium based on an input by user.

9. The ink jet printer according to claim 7, wherein the hue changing degree storage section and the hue changing degree determining section are configured to determine the hue changing degree based on penetrance of an ink with respect to the recording medium; and wherein the data conversion section converts the image data so that:

when the ink easily penetrates into the recording medium, an amount of an ink of a lately ejected color is increased in comparison with an amount of an ink of an early ejected color; and when the ink hardly penetrates into the recording medium, the amount of the ink of the lately ejected color is decreased in comparison with the amount of the ink of the early ejected color.

10. The ink jet printer according to claim 7, further comprising:

a test sample image storage section for storing a test sample image data including a plurality of hue changing degrees for each kind of the recording medium; and a sample/hue changing degree storage section for storing one hue changing degree, which is selected from the test sample image data of the kind of the recording medium determined by the recording medium specifying section, to correspond to the determined kind of the recording medium.

11. The ink jet printer according to claim 10, wherein the one hue changing degree is a hue changing degree having the lowest hue changing in the forward and reverse directions among the plurality of hue changing degrees.

12. A printing method using a print head having a nozzle array extending in a sub scanning direction wherein the nozzle array is arranged in a main scanning direction for each color and the print head reciprocally moves in the main scanning direction to print on a recording medium in both forward and reverse directions, the printing method comprising the steps of:

detecting a moving direction of the print head in the main scanning direction; and increasing an amount of an ink of a lately ejected color in comparison with an amount of an ink of a early ejected color irrespective of the detected moving direction of the print head, when printing an image on the recording medium using a mixed color.

13. The printing method according to claim 12, further comprising the steps of determining a kind of the recording medium, wherein in the increasing step, the increase of the amount of the ink is controlled based on the determined kind of the recording medium.

14. The printing method according to claim 13, wherein the kind of the recording medium is determined based on an input by user.

15. The printing method according to claim 12, further comprising the steps of decreasing the amount of ink of the lately ejected color in comparison with the amount of the ink of the early ejected color irrespective of the detected moving direction of the print head.

16. The printing method according to claim 15, further comprising the steps of determining a kind of the recording medium, wherein one of the increasing step and decreasing step is performed based on the determined kind of the recording medium, to control one of the increase and decrease of the amount of the ink.

17. The printing method according to claim 16, wherein in the determining step, the kind of the recording medium is determined based on an input by user.

18. A printing method using a print head having a nozzle array extending in a sub scanning direction wherein the nozzle array is arranged in a main scanning direction for each color and the print head reciprocally moves in the main scanning direction to print on a recording medium in both forward and reverse directions, the method comprising the steps of:

determining a kind of the recording medium;

determining a scanning pattern in the main scanning direction of the print head based on a recording mode inputted from external;

referring hue changing degree storage means for storing hue of each color in the forward and reverse directions at a time of printing an image on a recording medium with a mixed color, to determine the hue changing degree of each color based on the determined kind of the recording medium and the determined scanning pattern;

converting image data to be printed based on the determined hue changing degree.

19. The printing method according to claim 18, wherein in the recording medium specifying step, the kind of the recording medium is determined based on an input by user.

20. The printing method according to claim 18, wherein in the hue changing degree determining step, the hue changing degree is determined based on penetrance of an ink with respect to the recording medium; and wherein in the converting step, the image data is converted so that:

when the ink easily penetrates into the recording medium, an amount of an ink of a lately ejected color is increased in comparison with an amount of an ink of an early ejected color; and when the ink hardly penetrates into the recording medium, the amount of the ink of the lately ejected color is decreased in comparison with the amount of the ink of the early ejected color.

21. The printing method according to claim 18, further comprising the steps of:

storing a test sample image data including a plurality of hue changing degrees for each kind of the recording medium; and storing one hue changing degree, which is selected from the test sample image data of the determined kind of the recording medium, to correspond to the determined kind of the recording medium.

22. The printing method according to claim 21, wherein the one hue changing degree is a hue changing degree having the lowest hue changing in the forward and reverse directions among the plurality of hue changing degrees.

* * * * *